US005211381A

United States Patent [19]

Shaw

[11] Patent Number: 5,211,381

[45] Date of Patent: May 18, 1993

[54] TRUSS ASSEMBLING APPARATUS

[76] Inventor: Clifford Shaw, P.O. Box 1546, Sumter, S.C. 29151

[21] Appl. No.: 797,313

[22] Filed: Nov. 25, 1991

[51] Int. Cl.[5] ..... B30B 3/02

[52] U.S. Cl. ..... 269/37; 269/304; 269/910; 29/281.3

[58] Field of Search ..... 269/40, 43, 37, 303, 269/304, 910; 100/913; 29/281.1, 281.3, 897.31; 227/152, 154, 155

[56] References Cited

U.S. PATENT DOCUMENTS 2,212,421 8/1940 Henderson .
2,662,565 12/1953 Le Vay .
2,873,843 2/1959 Wilson .
3,036,609 5/1962 Quesenberry, Jr. .
3,255,943 5/1966 Sanford .
3,367,010 2/1968 Lytle et al. .
3,443,513 5/1969 Juriet et al. .
3,497,056 2/1970 Clark .
3,667,379 6/1972 Templin .
3,925,870 12/1975 Adams .
4,252,058 2/1981 Tison .
4,943,038 7/1990 Harnden .
5,085,414 2/1992 Weaver ..... 269/910
5,092,028 3/1992 Harnden ..... 269/910

*Primary Examiner*—Robert C. Watson
*Attorney, Agent, or Firm*—Michael A. Mann

[57] ABSTRACT

A truss assembly apparatus and method comprising a conveyor belt carrying a set of slats, a computer for generating an image of the set of slats and a pattern of stops for a truss jig, and a second set of slats that are used for setting up the jig in accordance with the pattern. The slats of the first set are held to the conveyor belt by spherical magnets partially encased in the undersides of the slats. Each slat is ruled and has holes formed therein for receiving the stops. The slats of the first set that are to be replaced with slats from the second set are ejected from the conveyor with an air gun to identify them and to facilitate their removal. The truss can then be assembled on the truss assembly portion of the conveyor belt as the truss is moved to the unloading portion of the conveyor. To attach the truss elements together, connector plates are seated in adjacent elements by rollers.

15 Claims, 3 Drawing Sheets

TRUSS ASSEMBLING APPARATUS

BACKGROUND OF THE INVENTION

1. Field of the Invention

The present invention relates to making trusses for home and office building construction. More particularly, the present invention relates to conveyor systems for assembling uniform, finished trusses.

2. Discussion of Background

To form support for a pitched roof for buildings and homes, framework structures called trusses are installed on the tops of the walls of the buildings to hold the roofing at the desired angle. The trusses, usually made of wood, comprise one or more bottom boards that will be oriented perpendicularly to the walls, two angled top boards, and several boards, called webbing, supporting the top boards from the bottom boards. The arrangement of boards is fixed by nailing connector plates, which are flat metal plates with spike-like perforations formed therein, to the sides of two or more boards where those boards intersect. The connector plates hold the various components of the trusses together in their appropriate spaced relation.

Although there are apparatus for assembling trusses for homes and office buildings, most truss assembling is still done either at the job site or by forming an ad hoc jig on a large table and making each truss using that jig. In the former case, the trusses may not be as uniform as would be expected if built under more controlled conditions. In the latter case, the time spent assembling the ad hoc jig is approximately one-third of the overall time to assemble the trusses. Furthermore, if a mistake is made in assembling the jig, it will be propagated through all the trusses built therewith.

There are several apparatus for facilitating the assembly of trusses. In particular, there are several using conveyor belts that move slats on which the trusses are assembled. See for example, the truss assembly jig of Adams as described in U.S. Pat. No. 3,925,870, the apparatus of Tison for forming wood trusses described in U.S. Pat. No. 4,252,058, and the truss assembly apparatus of Harnden as disclosed in U.S. Pat. No. 4,943,038. See also Templin's apparatus and Jureit, et al's apparatus in U.S. Pat. No. 3,667,379 and U.S. Pat. No. 3,443,513, respectively. All of these may streamline the production of trusses but none avoids the fundamental problem of the time to set up the truss jig on the conveyor. There remains a need for shortening this set up time.

SUMMARY OF THE INVENTION

According to its major aspects and broadly stated, the present invention is an apparatus for assembling trusses such as those made of wood for use in building homes and offices with peaked roofs. The apparatus comprises a surface carrying a set of slats and a representation or image of that surface with its slats, preferably stored and displayable on a computer. A supply of additional slats, identical to those carried by the surface is available near the surface. The surface is preferably a conveyor belt having a truss-assembling area and a truss-unloading area. The conveyor belt is moved by a variable speed motor having appropriate gearing. The slats are all physically interchangeable but each slat on the surface corresponds to a particular slat of the image. The slats and the represented slats are labeled and preferably color coded for easy identification, and are arranged to spatially correspond. Each slat is ruled and has holes formed in it for receiving stops that are used to form a truss jig.

To assemble a truss on the surface, a pattern is generated for a truss jig on the represented surface. The pattern contains instructions as to which slat receives stops and in which hole or holes along that slat the stops are to be placed. Slats from the additional supply of slats are then set up with stops at the locations indicated by the computer-generated pattern. When the stops are all in place on the additional slats and those slats are numbered to correspond to the slats on the surface, they are transferred to the surface. Preferably, the slats on the surface are held magnetically to that surface and can be freed from this magnetic hold using an air gun positioned below the surface and operationally connected to the keyboard used for preparing the pattern. Using the keyboard, the slats on the surface that are to be replaced are partially ejected above the surface to identify the particular slats that are to be replaced with corresponding slats of the additional set.

Once the jig is established on the conveyor, the elements that will form the truss are put into position against the stops. Then connecting plates for holding the elements together are seated by rollers in the usual manner.

Setting up the jig separately and then transferring the slats with stops to the conveyor belt is an important feature of the present invention. While the conveyor belt is being used for the assembly of other trusses, the spare slats are being set up. Then, in a short time, the replacement slats bearing the stops in position for the next truss jig can be exchanged with the corresponding slats from the surface. The advantage of this feature is greater productivity from the conveyor since relatively more time is used to assemble trusses and relatively less time used to prepare the conveyor surface.

The design of the slats themselves is an important feature of the present invention. The slats are predrilled with holes at close intervals for receiving the stops. They are fitted with spherical magnets on their undersides to cause the slats to adhere in a releasible manner to the chain drive of the conveyor. They are color-coded and numbered to make them easy to exchange between jig set-up surface and truss assembly surface. All of these features enable the slats to be easily identified for stopping and to be quickly exchanged to minimize jig set-up time.

Because of the nature of the slats, specifically their ruled sides and predrilled holes, the pattern for stops that forms a jig may be computer generated. Using simple algorithms, a computer or processor can establish the stop pattern and "tell" the truss assembly surface which slats to exchange. This feature eliminates many potential errors with ad hoc jigs.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
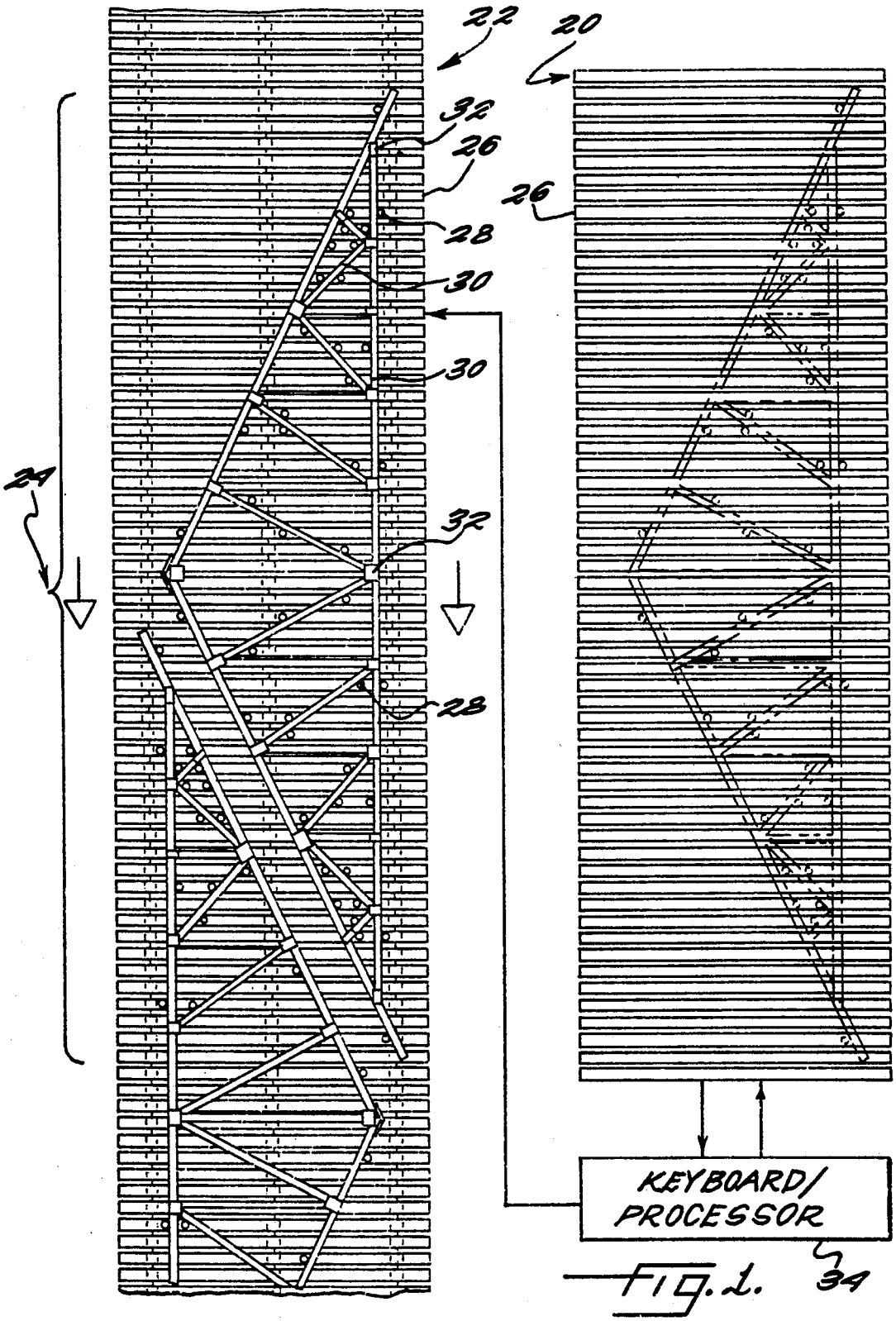
FIG. 1 is a top view of the truss assembly surface according to a preferred embodiment of the present invention with the truss set-up pattern as would be seen on a computer screen shown to the side.

Referring now to FIG. 1, there is illustrated a top view of an image 20 of slats and a truss assembly surface 22. A jig pattern is established using image 20 and then transferred, as will be herein described, to truss assembly surface 22. The establishment of the truss as an image 20 (as indicated by a truss shown in broken lines on image 20) and the transfer of the jig pattern to assembly surface 22 (where the identical truss shown in broken lines on image 20 is shown in solid lines on truss assembly surface 22) is simplified by the present invention and thus saves considerable amounts of time otherwise required for the establishment of jigs on a typical truss assembly surface.

Alternatively, rather then using a computer, the pattern can be set up on a table off to the side of assembly surface 22.

Image 20 and the portion of truss assembly surface 22 to which it corresponds are identical. That portion is the truss assembly area 24. Trusses are assembled on this area and moved in the direction of the arrows toward an unloading area, as will be described.

Surface 22 comprises a plurality of slats 26 which receive stops 28 that guide the assembly of trusses by limiting the positions and relative orientations of truss elements 30. Once elements 30 are in place, connector plates 32 can be put into position to attach elements 30 to each other. The pattern of stops 28 is developed from an architectural drawing of a truss by a suitably programmed general purpose computer or special purpose processor 32, as shown.

Figures 2A, 2B, 2C, 3:
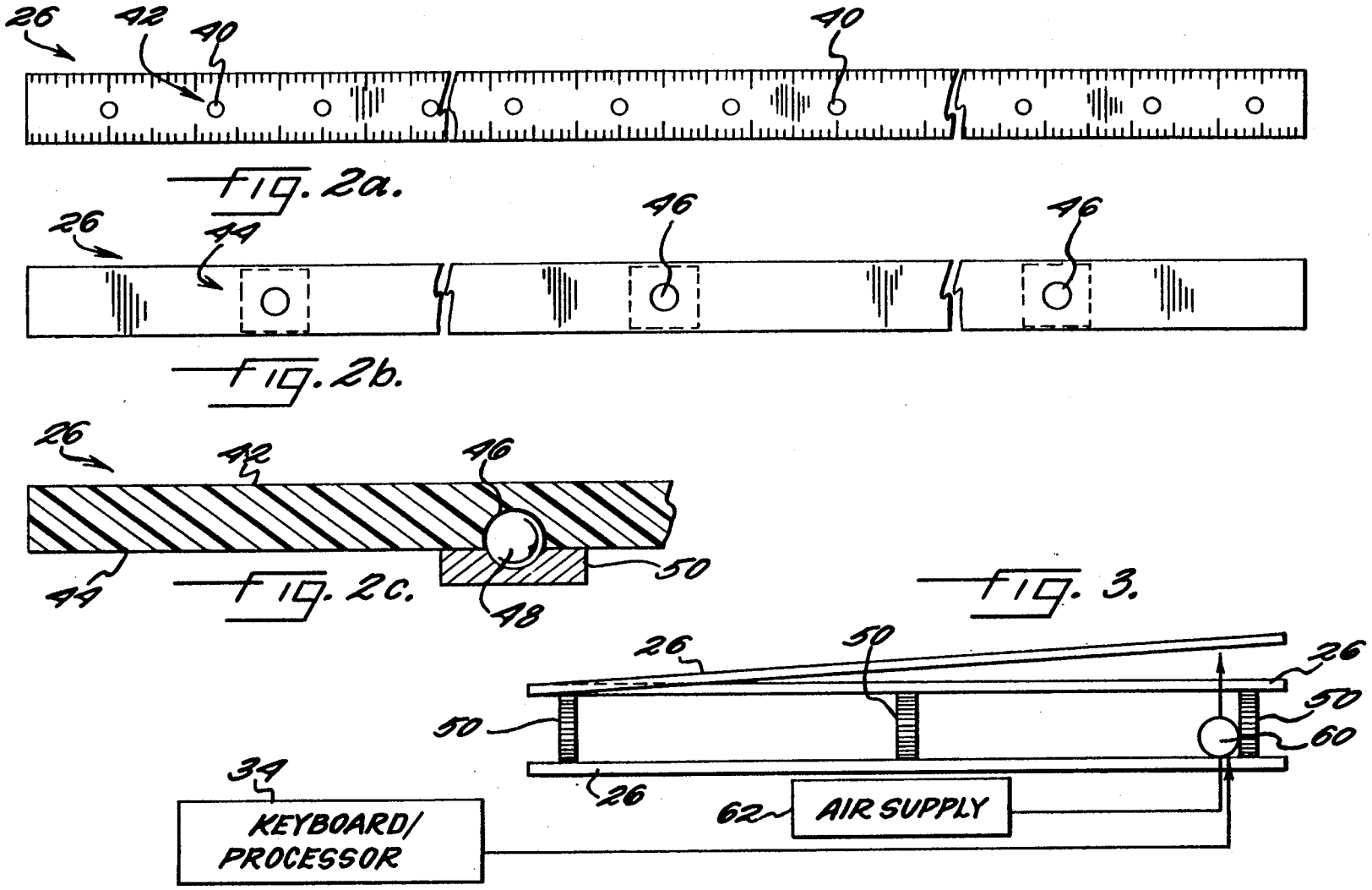
FIGS. 2*a*, 2*b* and 2*c* show the top, bottom and side views of a slat according to a preferred embodiment of the present invention.
FIG. 3 is a cross-sectional, partially schematic view of the conveyor showing the method for identifying a slat to be removed.

Slats 26 are shown in detail in FIGS. 2*a*, 2*b*, and 2*c*. Each slat 26 is rectangular, ruled along both long edges and dimensionally identical to every other slat 26. Each will have a plurality of holes 40 formed in the top surface 42 that are threaded to receive stops 28. Each hole is preferably ⅜ths inch in diameter, ½ inch deep, and spaced six inches, center-to-center, from the adjacent holes. Stops are short rods with a portion of their length threaded to mate with the threads of holes 40. On the underside 44 of each slat 26 are three spherical depressions 46, each holding a spherical magnet 48 that extends below slat 26 slightly but is otherwise held in place within slat 26. Magnets 48 hold slats 26 to three conveyor chains 50 that can advance truss assembly surface 22.

As an example of how slats 26 would be used to set up a jig for a truss, the truss design, stored on computer, would be scanned to locate the sides of each element 30 comprising a top member, bottom member or webbing member that is not butted against another element 30. At least three stops 28 would be used to fix that element 30, one on one side and two on an opposing side (see FIG. 1). On image 20 a stop 28 would be placed near one end at the closest hole 40 on slat 26 and another stop 28 on the same side near the other end. The third stop 28 is placed on the opposite side anywhere between the first two stops 28. Three stops are sufficient to brace an element 30. More sophisticated programming can further reduce the number of stops needed for bracing when, for example, the top and bottom members are braced first and used to partially brace each other and webbing members. Once the positions of each stop 28 are known, the computer can produce a list of stops 28 by slat 26 and by position on each slat 26.

As shown in FIG. 3, each slat 26 on truss assembly surface 22 can be lifted by an air jet 60 connected to a suitable air supply 62 in response to commands from processor 34. Air jet 60, when processor 34 is so directed by pressing keys of a keyboard that identify that particular slat, will lift slat 26, thus identifying it as the slat to be replaced from truss assembly surface 22 with a corresponding slat per image 20. Each slat represented by image 20 must correspond with one slat from truss assembly surface 22. Preferably, each slat to replace a slat on surface 22 will be marked with a number that corresponds with the number on the slat 26 from surface 22 it will replace so that slat number 101, for example, of image 20 corresponds to slat number 101 of truss assembly surface 22. To further facilitate the identification of corresponding slats, they can be color-coded. Slats 26 are preferably made of rigid, unbreakable plastic such as engineering grade NYLON that can take on a variety of different dyes.

Figure 4:
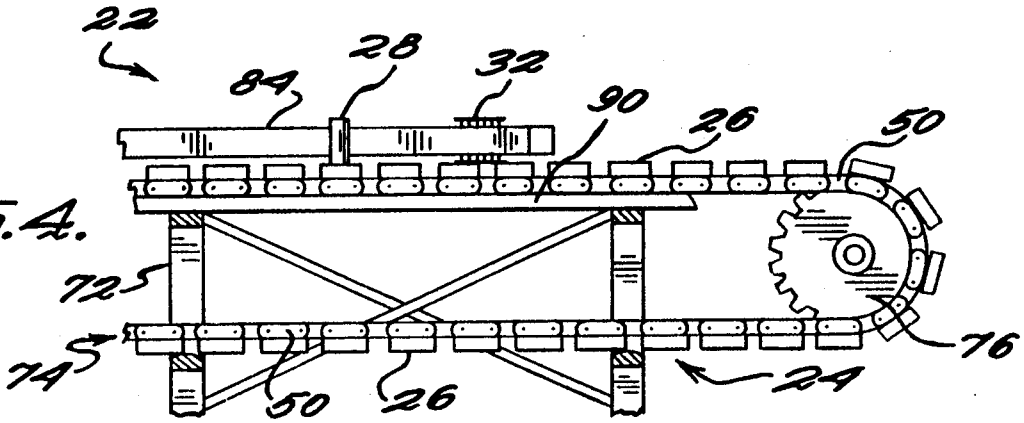
FIGS. 4 and 5 show a side view in two parts of the complete truss assembly surface according to a preferred embodiment of the present invention.
Figure 5:
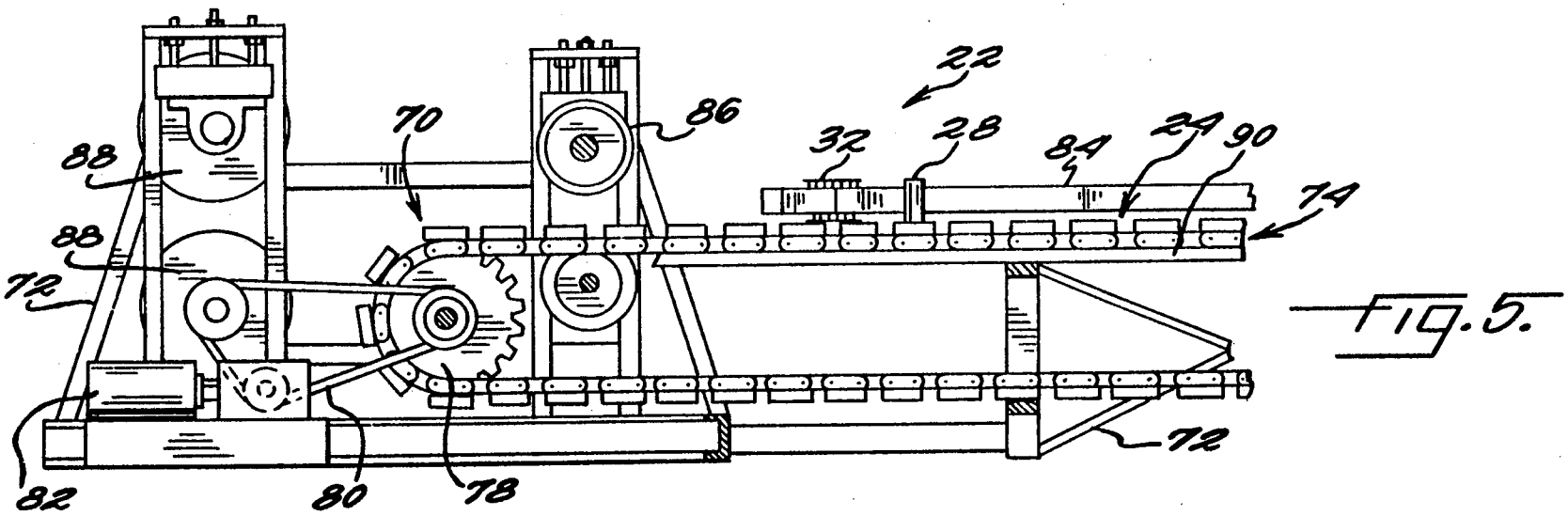

FIGS. 4 and 5 show, in two parts, a side, cross-sectional view of the complete truss assembly surface 22 with truss assembly area 24 and a truss unloading area 70. Surface 22 is part of a frame 72 supporting a continuous conveyor 74 formed of three chains 50 that are turned by gears 76, 78. Gear 78 is turned by a belt 80 driven by a motor 82. Motor 82 is preferably a variable gear drive-type that is capable of a nominal speed of ⅓ mile per hour. As a truss 84 is moved toward unloading area 70, it will pass under a first, or "pinch" roller 86 that partially seats connector plates 32. A set of finish rollers 88 following first roller 86 fully seats plates 32.

After truss 84 is unloaded, conveyor 74 continues to move slats 26 with stops 28 back to truss assembly area 24 for another truss to be assembled thereon. A heavy-duty table, such as a steel table 90 is under conveyor 74 for support of the chain. As indicated in FIG. 1, more than one truss can be assembled on conveyor 74 if the appropriate stops 28 are in place.

In a conveyor having a 120-foot length, with slats being four inches wide and 14 feet long, there will be not more than 720 slats, allowing no distance separating them, or approximately 480 slats, with two inches separating each one.

It will be apparent to those skilled in the art that many changes and substitutions can be made to the preferred embodiment herein described without departing from the spirit and scope of the present invention as defined by the appended claims.

What is claimed is:

1. An apparatus for assembling trusses, said apparatus comprising:

a surface for assembling trusses;

means for moving said surface, said surface having a truss-assembling area and a truss-unloading area, said trusses being assembled at said truss-assembling area and unloaded at said truss-unloading area, said trusses being carried from said truss-assembling area to said truss-unloading area by said surface when said surface is moved by said moving means;

a first set of slats removably carried by said surface;

a second set of slats, each slat of said second set of slats interchangeable with slats of said first set of slats;

a plurality of stops for forming truss jigs in accordance with a pattern of stops, said slats of said first and said second sets of slats having means formed therein for receiving said stops; and means for generating said pattern of stops so that said second set of slats can receive said stops in accordance with said pattern of stops and said second set of slats with said stops can replace slats of said first set of slats on said surface.

2. The apparatus as recited in claim 1, further comprising means for identifying slats of said first set of slats that are to be replaced by slats from said second set of slats.

3. The apparatus as recited in claim 1, wherein said slats of said first set of slats are magnetically held to said surface.

4. The apparatus as recited in claim 1, wherein said slats of said first set of slats are magnetically held to said surface and further comprising means for forcing a slat out of the magnetic hold to said surface so that said slat is identified as a slat to be removed from said surface.

5. The apparatus as recited in claim 1, wherein each slat of said first and said second set of slats is ruled.

6. The apparatus as recited in claim 1, wherein each of said slats is color coded.

7. The apparatus as recited in claim 1, wherein said receiving means of said slats of said first and said second sets of slats further comprise a plurality of threaded holes.

8. An apparatus for assembling trusses, said apparatus comprising:

a conveyor belt;

means for moving said conveyor belt, said conveyor belt having a truss-assembling area and a truss-unloading area, said trusses being assembled at said truss-assembling area and unloaded at said truss-unloading area, said trusses being carried from said truss-assembling area to said truss-unloading area by said conveyor belt when said conveyor belt is moved by said moving means;

a first set of slats removably carried by said conveyor belt;

means for generating an image of said first set of slats and a pattern of stops represented on said image;

a second set of slats, each slat of said second set of slats interchangeable with slats of said first set of slats; and a set of stops for forming said truss jig, each of said slats of said first set of slats ruled and carrying first means for labeling said each slat of said first set of slats, and each slat of said second set of slats ruled, and each of said slats having means formed therein for receiving stops of said set of stops.

9. The apparatus as recited in claim 8, wherein said trusses are made of elements attached together with connectors and wherein said apparatus further comprising means for seating said connectors, said seating means in spaced relation to said unloading area of said conveyor belt so that said seating means receives said assembled trusses as said trusses are conveyed from said unloading area.

10. The apparatus as recited in claim 8, wherein said slats of said first and said second set of slats are ruled.

11. The apparatus as recited in claim 8, further comprising means for identifying slats of said first set of slats that are to be replaced by slats from said second set of slats.

12. The apparatus as recited in claim 8, wherein said slats of said first set of slats are magnetically held to said surface.

13. The apparatus as recited in claim 8, wherein said slats of said first set of slats are magnetically held to said surface and further comprising means for forcing a slat out of the magnetic hold to said surface so that said slat is identified as a slat to be removed from said surface.

14. The apparatus as recited in claim 8, wherein said stops are threaded and said receiving means of said slats of said first and said second sets of slats further comprise threaded holes, said threaded holes receiving said threaded stops.

15. The apparatus as recited in claim 8, wherein each of said slats is color coded.

* * * * *

UNITED STATES PATENT AND TRADEMARK OFFICE

CERTIFICATE OF CORRECTION

PATENT NO. : 5,211,381

DATED : May 18, 1993

INVENTOR(S) : Gifford Shaw

It is certified that error appears in the above-indentified patent and that said Letters Patent is hereby corrected as shown below:

On the title page, in item [75] the inventors name "Clifford Shaw" should read --Gifford Shaw--.

Signed and Sealed this

Eleventh Day of January, 1994

Bruce Lehman

*Attest:*

BRUCE LEHMAN

*Attesting Officer*

*Commissioner of Patents and Trademarks*